US007181859B2

(12) United States Patent
Lai

(10) Patent No.: US 7,181,859 B2
(45) Date of Patent: Feb. 27, 2007

(54) INSTRUCTIONAL TEMPLATE STRUCTURE FOR AIDING INSTALLATION OF WALL BRACKETS

(75) Inventor: Ming-Hsiao Lai, Chang-Hua Hsien (TW)

(73) Assignee: Shenter Enterprise Co., Ltd., Chang-hua Hsien (TW)

( * ) Notice: Subject to any disclaimer, the term of this patent is extended or adjusted under 35 U.S.C. 154(b) by 583 days.

(21) Appl. No.: 10/677,814

(22) Filed: Oct. 3, 2003

(65) Prior Publication Data

US 2005/0016122 A1 Jan. 27, 2005

(30) Foreign Application Priority Data

Jul. 19, 2003 (TW) ..... 92213247 U

(51) Int. Cl.
*B25H 7/00* (2006.01)

(52) U.S. Cl. ..... 33/563; 33/1 B

(58) Field of Classification Search ..... 33/1 B, 33/562, 563, 566, 613, 645
See application file for complete search history.

(56) References Cited

U.S. PATENT DOCUMENTS

| | | | | |
|---|---|---|---|---|
| 5,107,601 | A * | 4/1992 | Semchuck | 33/563 |
| 6,430,834 | B2 * | 8/2002 | Myers et al. | 33/566 |
| 6,952,887 | B2 * | 10/2005 | Muchnik | 33/645 |
| 2001/0040113 | A1 * | 11/2001 | Wong | 206/485 |

* cited by examiner

*Primary Examiner*—G. Bradley Bennett
(74) *Attorney, Agent, or Firm*—Egbert Law Offices

(57) ABSTRACT

An instructional template structure for aiding the installation of wall brackets, which is primarily characterized by incorporating a template backboard in a wall bracket packaging box, which can either be placed inside the packaging box or included to the side of the packaging box. Relative dimensions of an assembly hole-boring layout at a scale of 1 to 1 are provided for assembling the rear ends of wall brackets. The template features an improved structural design as the intended purpose and yield that offers an innovative practicality in aiding the installation of wall brackets in a swifter and more precise manner.

7 Claims, 17 Drawing Sheets

INSTRUCTIONAL TEMPLATE STRUCTURE FOR AIDING INSTALLATION OF WALL BRACKETS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The preferred embodiment as proposed under this invention pertains to a template structure, particularly referring to one that suffices to aid wall bracket mounting in a swift and precise manner of a new model structural design.

BACKGROUND OF THE INVENTION

Where the term wall bracket pertains to the type of do-it-yourself wall-mount rack-configured products, while currently there are a number of products featuring such wall-mount rack function and configuration are available in the marketplace, such as a towel rack, soap rack, ring hanger rack and so forth; most of which are on display and sale at the retail venues, where the consumer would purchase the product and assembly on their own in a do-it-yourself manner as commonly referred to. A brief description is hereby provided to illustrate the theory behind mounting and positioning the rear segments of most conventional wall brackets as follows.

As shown in FIG. 16, between the rear contact surface 61 of the wall bracket 60 kit and the wall usually comes with a template 62, which is punctured with assembly holes 63; a position edge 64 on one side of the backboard 62; a screw hole 65 for accommodating a position bolt 66 at one side of the rear contact surface 61 of the wall bracket 60 kit to held down the aforementioned position edge 64. While the means of installation usually requires that the consumer to drill holes 67 according to positions that correspond to the assembly holes 63 punctured on the backboard 62, before plastic rivets 68 are inserted and the bolts 69 secured in place upon aligning the wall bracket 60 kit assembly holes 63 to the plastic rivet inserted holes 68. The rear contact surface 61 of the wall brackets 60 are then assembled onto the backboard 62, which is held in by the positive bolts 66 to complete the mounting procedure as shown in FIG. 17. Simply as it may sound, most of those who have attempted to do so often find a common frustration that in spite of a wall bracket dimensional drawing that most of the manufacturers include in the packing box that the consumer can follow to carry out the installation. Yet a crucial point arisen from the fact that most of the consumers are not skillfully trained often leads to discrepancies on position of the holes being drawn onto the wall, which in turn leads to the problems of misaligned holes or crookedness as the brackets are installed, rendering a less than ideal state of installation and frustrates the consumer with annoyance and inconvenience.

The foregoing problematic points also reflect a market demand in terms of how the manufacturer should best devise a product configuration mode that aids completing the wall bracket installation in a swift and precise manner, with respect to the foregoing potential consumption need to address the consumers' needs. These consumer needs warrant an objective and focus by industry operators, who are compelled to study and achieve breakthroughs.

BRIEF SUMMARY OF THE INVENTION

Facts pertaining to the invention functional yields are recapped as follows:

1. The presence of the unique structural design of the template is able to facilitate wall bracket mounting in a swifter and precise manner with practical progressives.
2. The template, as incorporated at a visible spot of wall bracket packaging depicting its structural feature, allows the consumer to easily discern the convenience in installation through the template display at the retail venue to greatly enhance the product, add value, and excel the consumer's desire to purchase.
3. The presence of a one-body construction template that is incorporated into the structural design of the packing box allows the producer to attain a swifter and more precise objective without accruing additional cost, and achieve an optimized industrial utilization.

DETAILED DESCRIPTION OF THE INVENTION

To facilitate the review board discerning and deciphering the objective, characteristics and functional yield of the invention, a summary of illustrated drawings have included for easy references.

Figure 1:
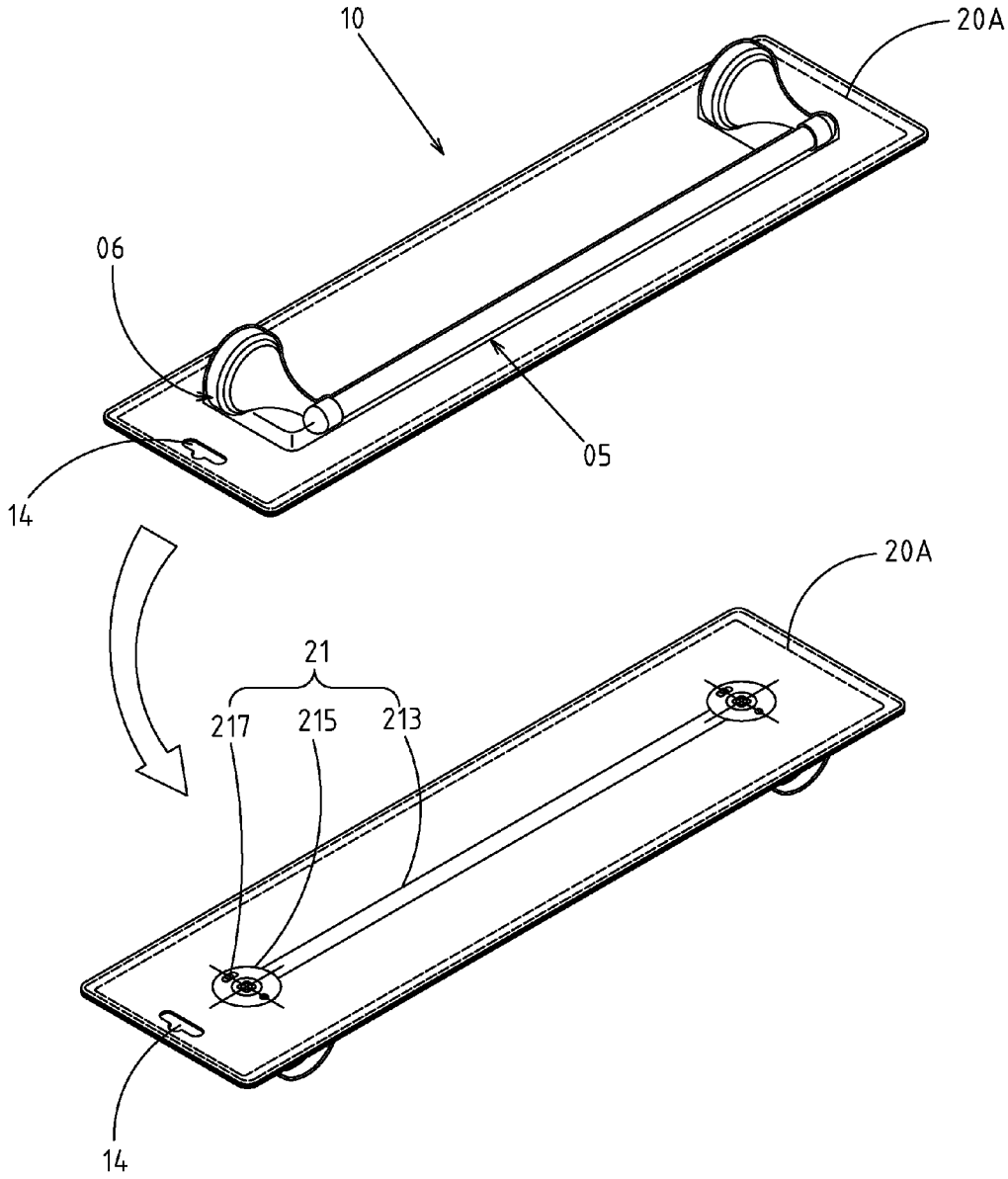
FIG. 1 is an upper perspective view showing front and back views of the invention in a first embodiment.
Figure 2:
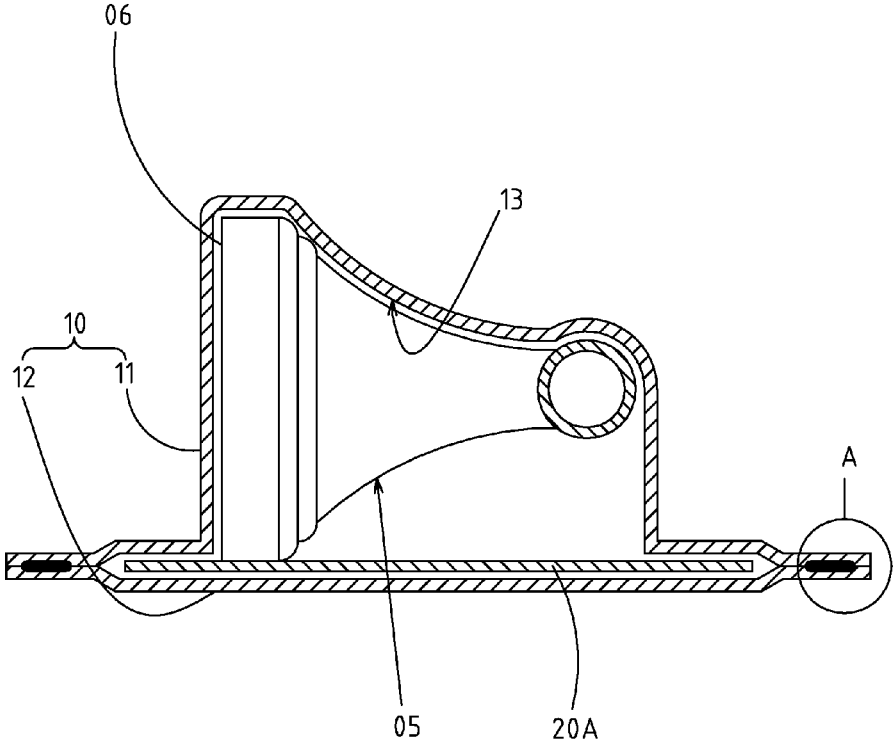
FIG. 2 shows cross-sectional view of the first embodiment of the invention.
Figure 3:
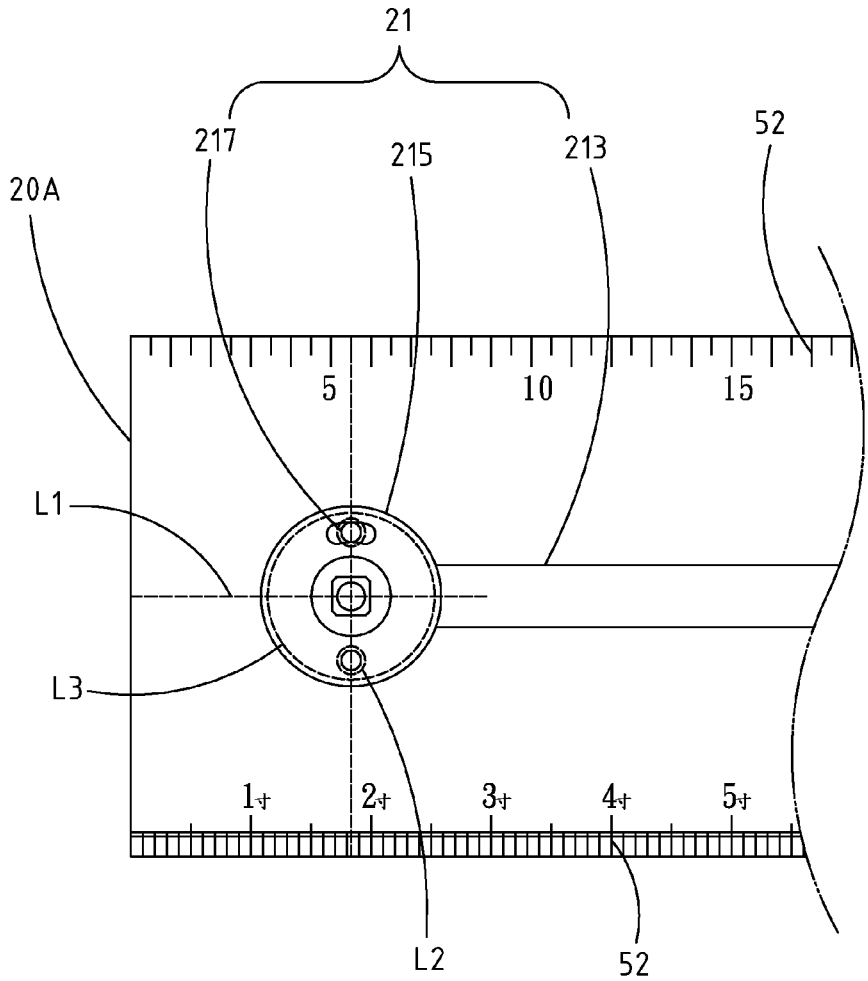
FIG. 3 shows a partial close-up back view of the first embodiment of the invention.
Figure 4:
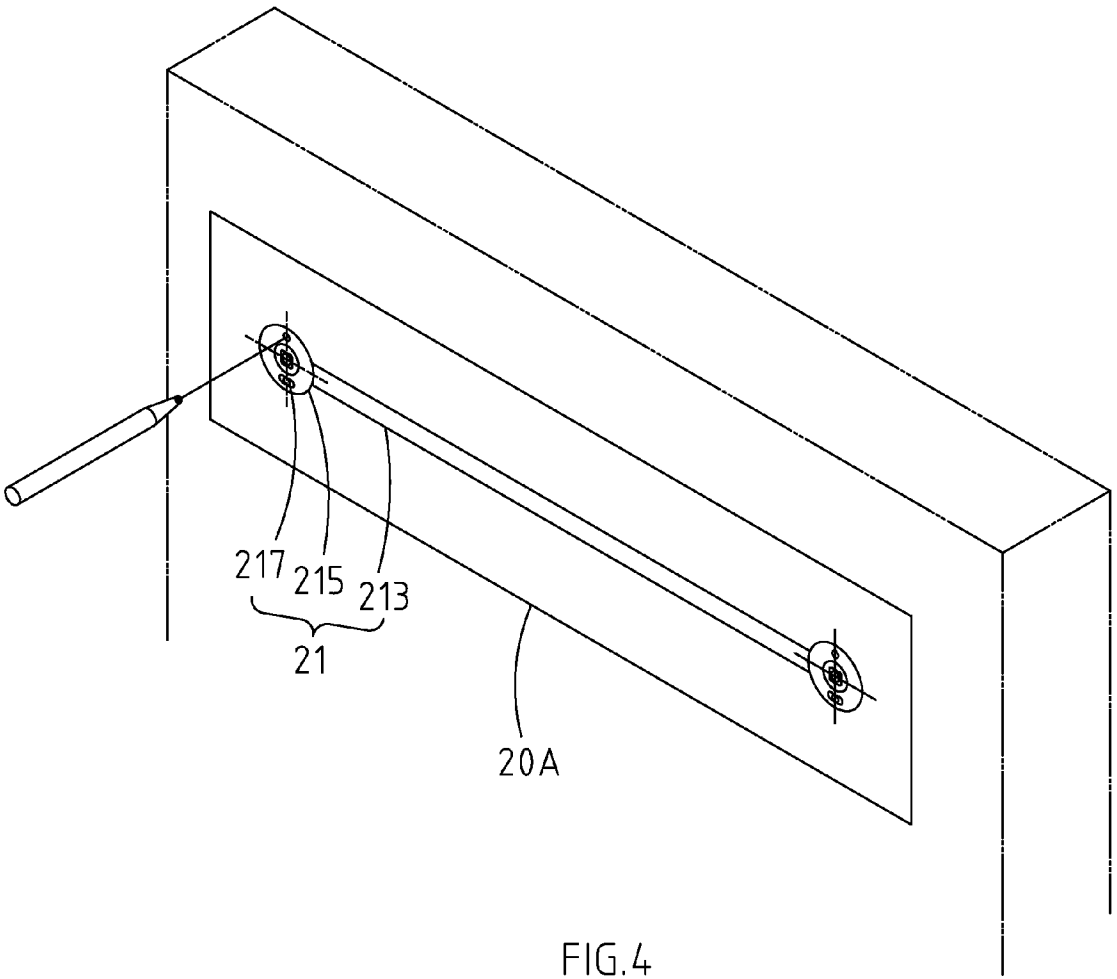
FIG. 4 shows a perspective view of a step for installation of the first embodiment of the invention.

Firstly, please refer to that shown under FIG. 1, FIG. 2 and FIG. 3, depicting an illustrated implementation of an instructional template for aiding the installation of wall brackets as proposed by the invention, which is comprised of:

a packing box 10A, which provides a compartment 13A for accommodating the prefabricated wall brackets 05, (as depicted in the drawing of a towel rack); and a template 20A, which can be placed anywhere inside the packing box 10, and on said template 20A is one that has been furnished with position hole markings 21 at a 1:1 scale as layout marking for the assembly holes 061 of the wall bracket 05 kit contact end 06. The packing box 10A can be one that is comprised of a cover casing 11 and bottom casing 12 as shown in FIG. 1 and FIG. 2, where the formation of the upper casing 11 has room 13A to accommodate the wall brackets 05, and that the parameters A where the upper and bottom casings 11, 12 come to meet are made into an interlocking hanging clamp and shall form, with one side of it punctured, a hang hole 14, in which the template 20A is held in by the upper/lower casings 11, 12 in the form of an insert card for the wall brackets.

Of which, the template 20A hole marking drawing 21 can take to the form of contour outlines 213 of the rear of the bracket, contour outlines 215 for the contact end of the wall brackets 05, and contour outlines 217 of the assembly holes.

Figure 5:
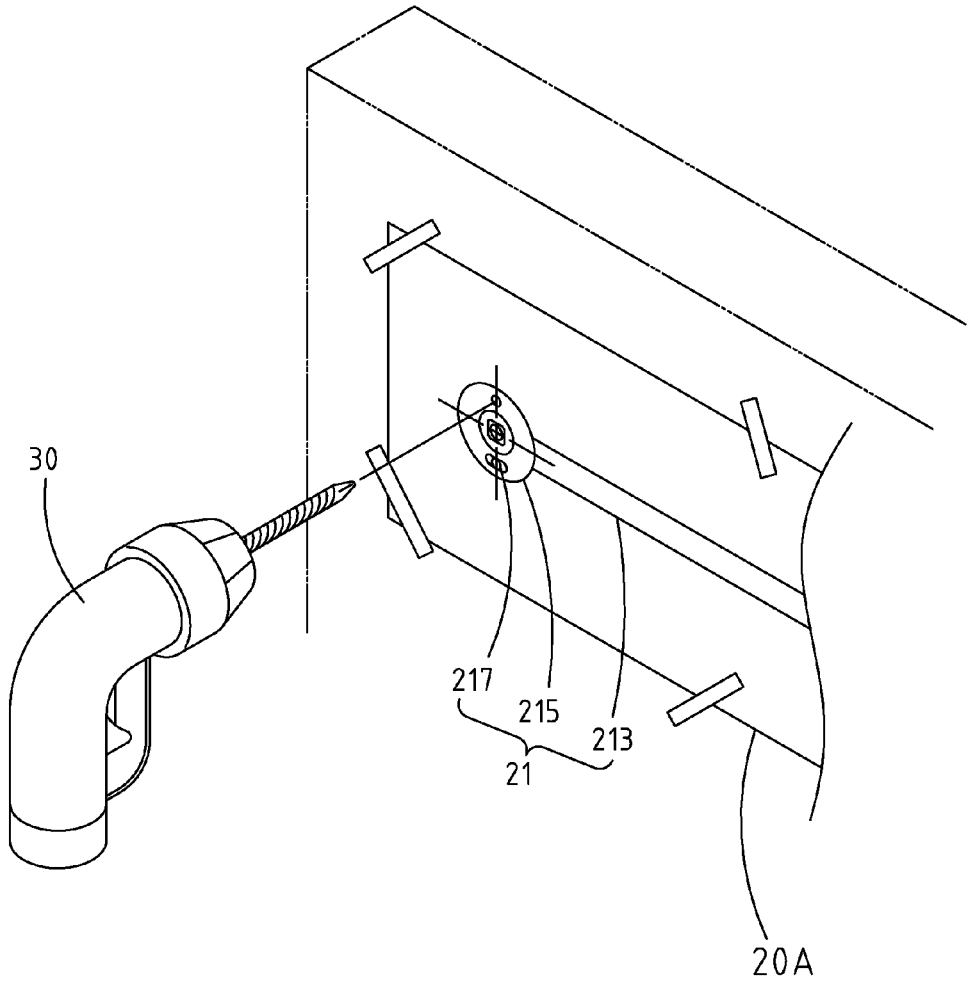
FIG. 5 shows another perspective view of another step for installation of the first embodiment of the invention.

In accordance with the foregoing stated structural feature, a key lies in that the template 20A can be used as a fixture for planning the hole boring on the wall prior mounting the wall bracket 50, which pertains to applying the template 20A flush against the wall and has the template 20A held in by hand, or has it affixed to the wall temporarily using adhesives, where the assembly hole contour outlines 217 shown on the template 20A could easily allow the installer to mark locations where the holes are to be bored easily using a pen before removing the template 20A and carrying out the hole-boring procedure. Or as an alternative as shown in FIG. 5, the template 20A can be left on, and the hole boring operation can be conducted directly onto the assembly hole contour outlines 217 appearing on the template 20A. This would conclude the purpose and method of use for the template 20A disclosed under the creation, while further description covering how the contact end 06 of the wall brackets 05 are mounted onto the wall that has been described in full under the prior art section would not be repeated in the ensuing patent description.

Figure 6:
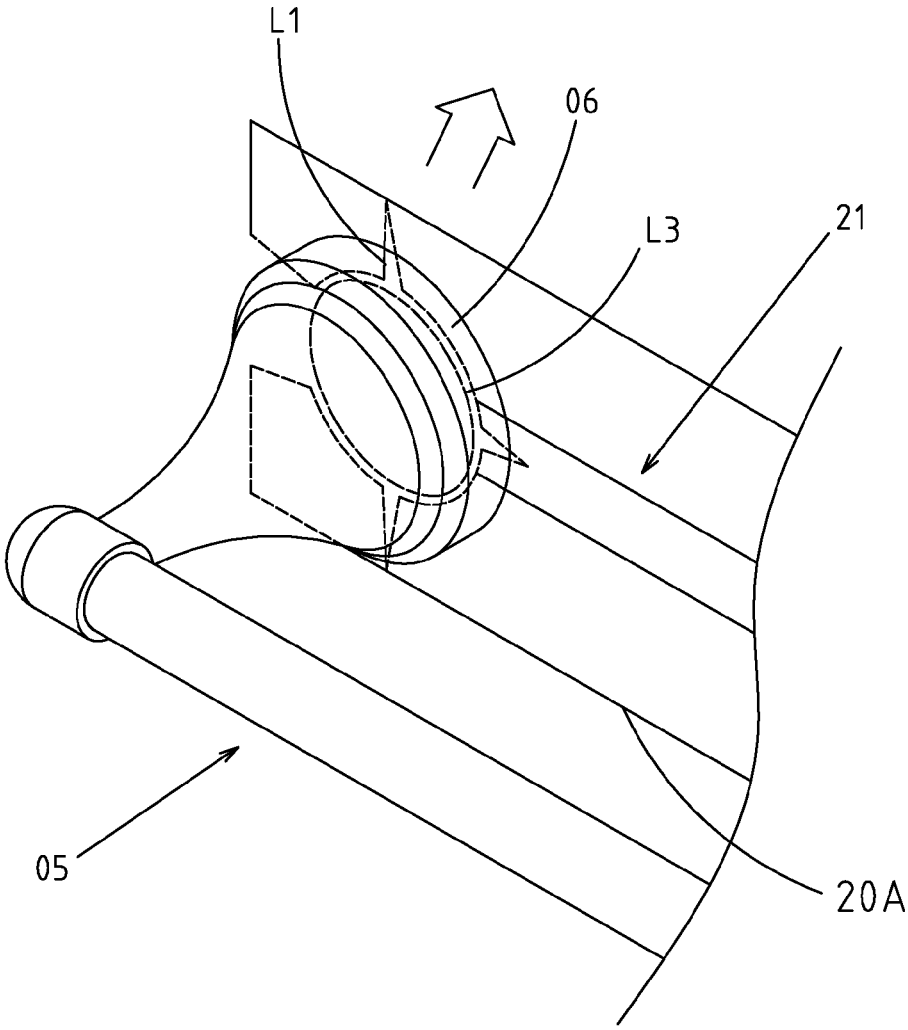
FIG. 6 shows still another perspective view for still another step for installation of the first embodiment of the invention.

Whereof, at the template 20A hole marking drawing 21 that is marked with wall bracket 05 assembly contact point outlines 215, assembly hole outlines 217 can be incorporated with perforation lines L1, L2 and L3 as shown in FIG. 3, in which the purpose of the assembly contact point X perforation L1 and round perforation L3 is as shown in FIG. 6. Following the contact points 06 of the wall brackets 05 that are securely fasten to the pre-bored holes on the wall, the user will be able to tear down the template 20A, and the X perforation L1 would serve to provide easy tearing of the template 20A, and the round dot inside the round perforation L3 will be left inside the contact point of the wall brackets 05. While the purpose of the perforation line L2 along the assembly hole outlines 217 lies in providing a punctured hole by breaking it to facilitate the entry of a marker or drill bid.

Figure 7:
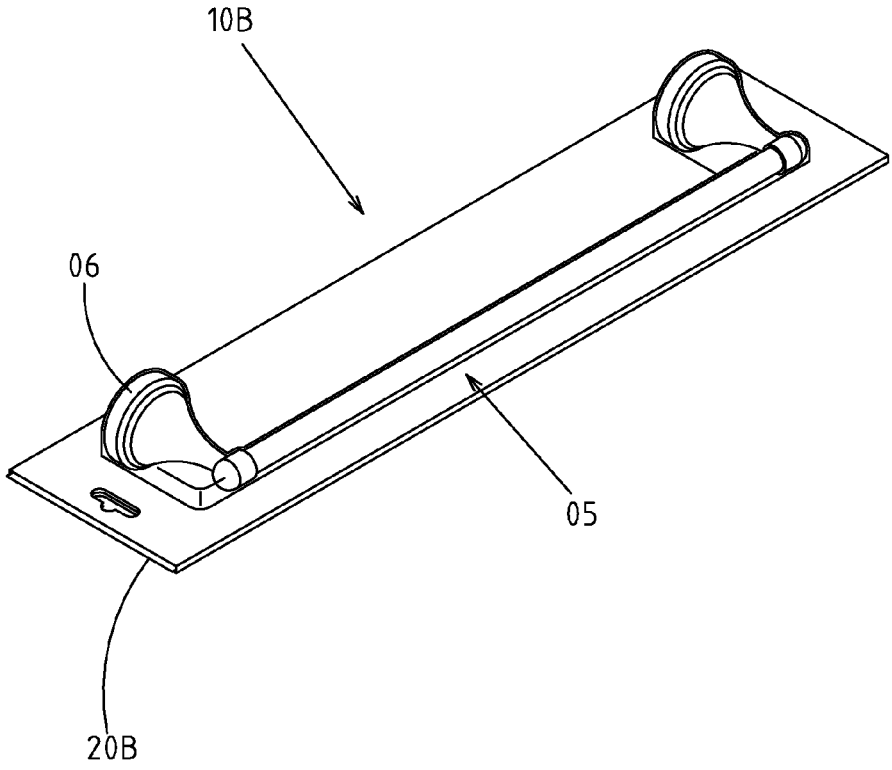
FIG. 7 shows a perspective view of a configurable packing box for the first embodiment of the invention.
Figure 8:
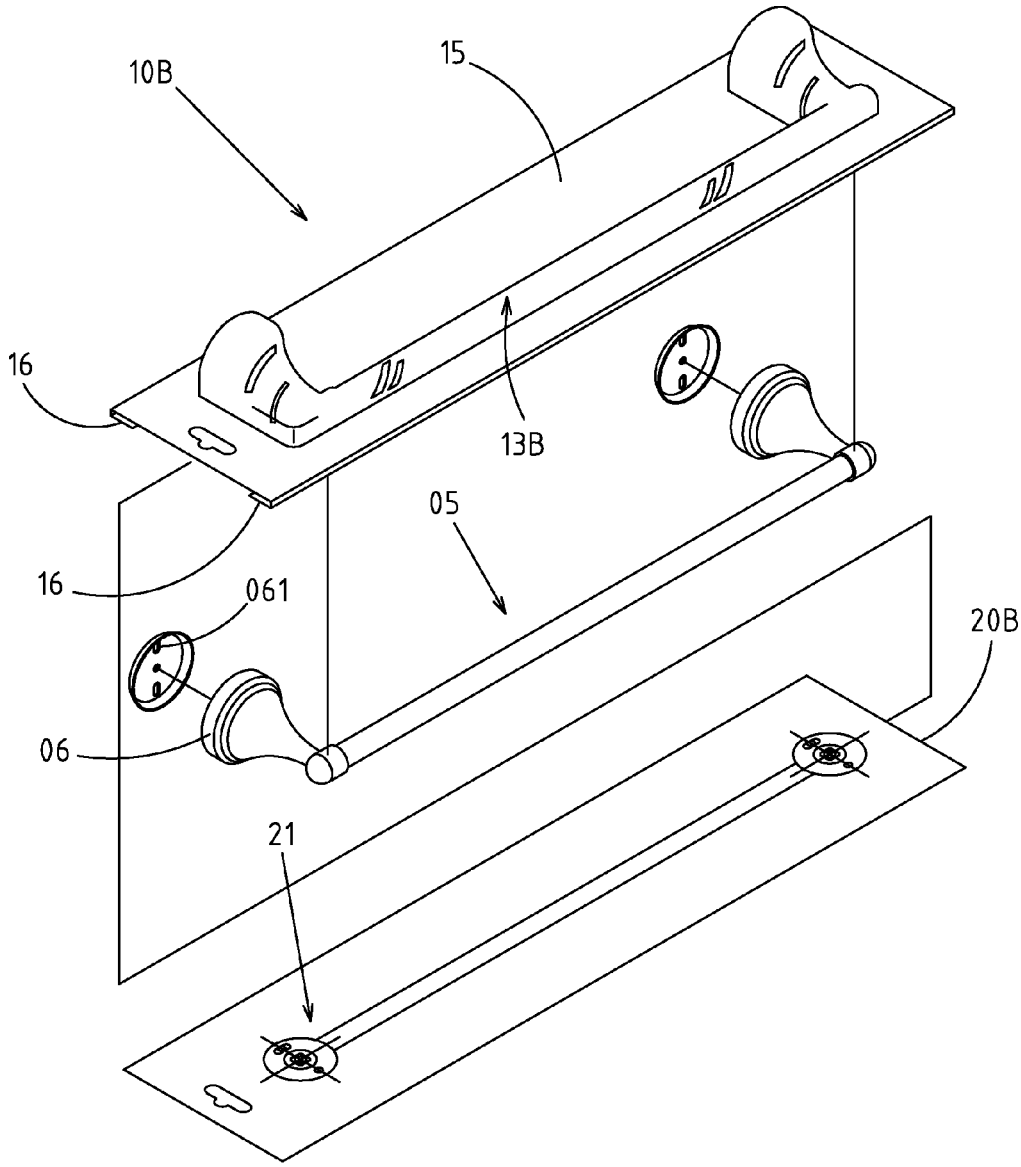
FIG. 8 shows another exploded perspective view of the configurable packing box for the first embodiment of the invention.

As disclosed in FIG. 7 and FIG. 8, the packing box 10B can also be made in the form of single-sided clamp shell 15 in a hung clamp shell container, and inside the clamp shell 15 is compartment 13B reserved for placing the wall brackets 05, on which one side of the clamp shell 15 contains an opening, which is intended to form a foldable flange 16, allowing the two ends of the template 20B to fit into the two sides of the flange 16 as the backboard of the packing box 10B.

Figure 9:
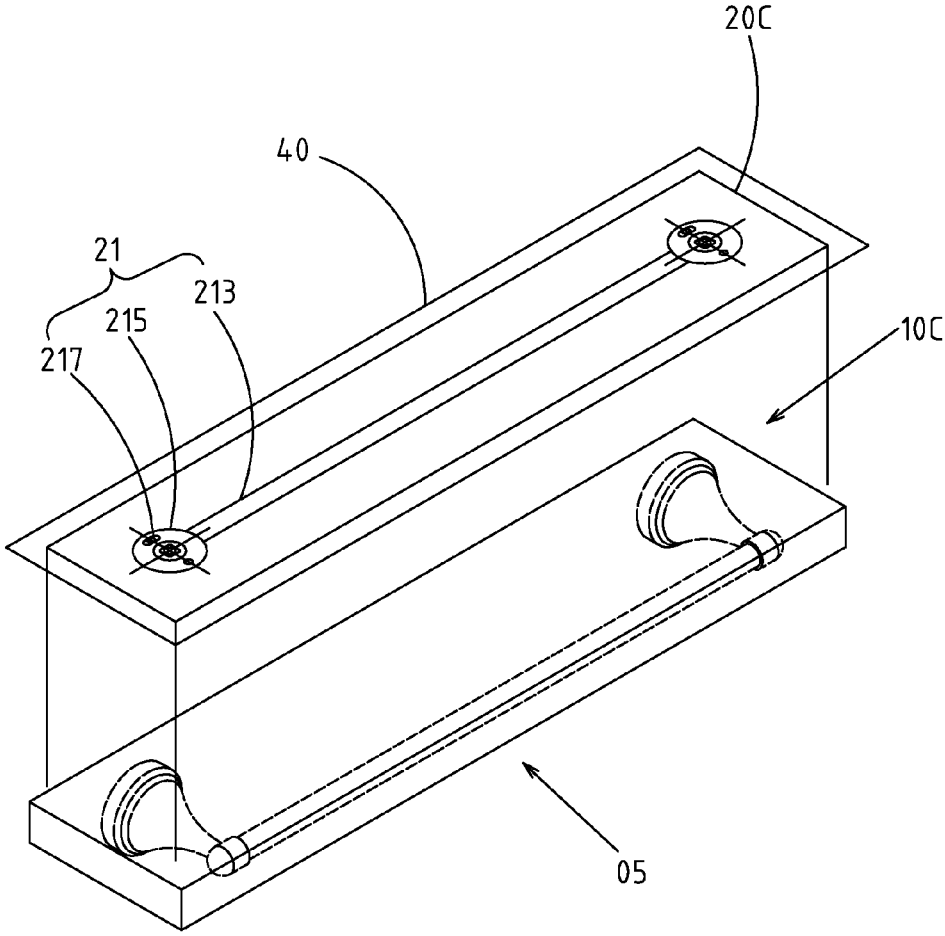
FIG. 9 shows a perspective view of a template assembly for application of the first embodiment of the invention.

Whereof, as shown in FIG. 9, the template 20C can also be placed into a sealer 40, which is then included to any given one side of the packing box 10C as an attachment via adhesives or strapping.

Figure 10:
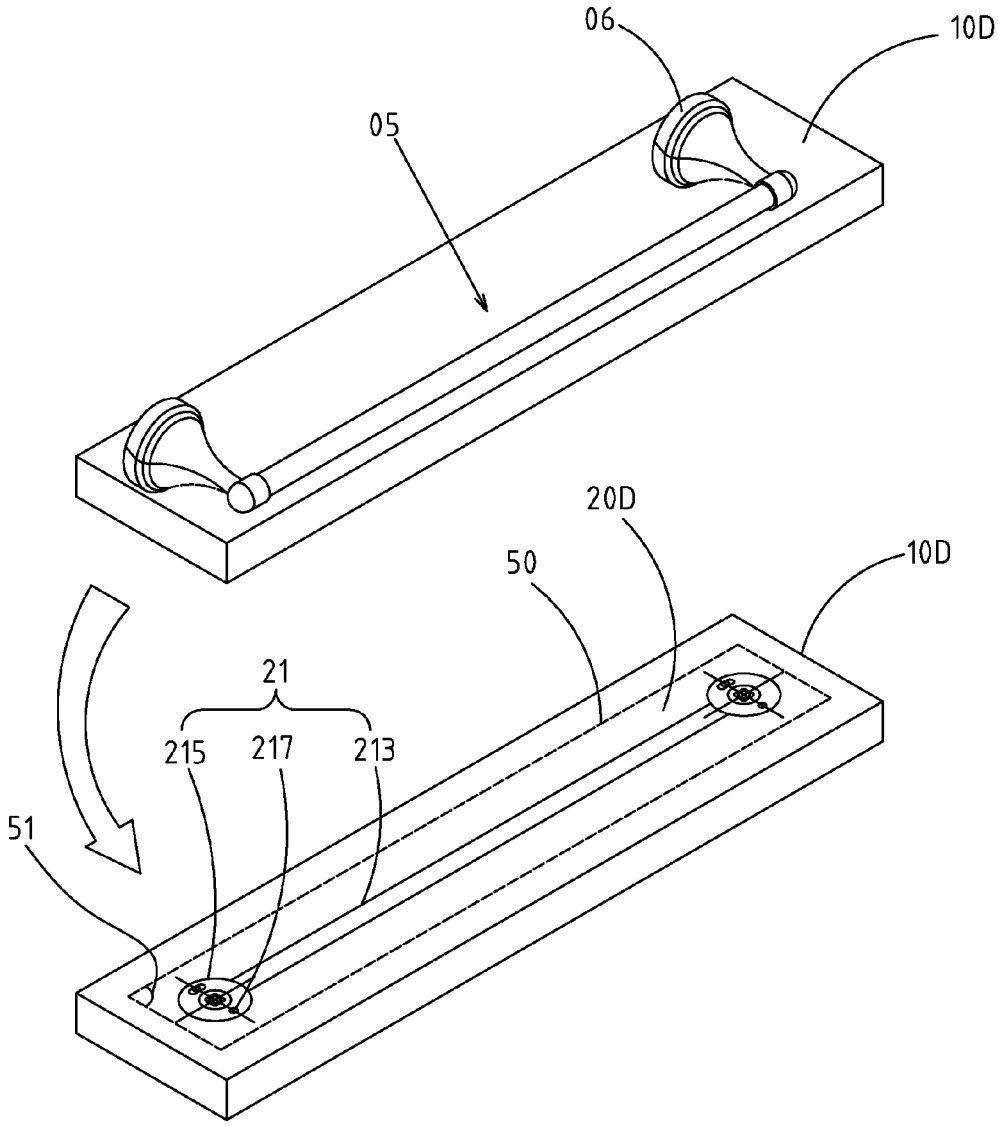
FIG. 10 shows a perspective view corresponding to the front and back views of the second embodiment of the invention.
Figure 11:
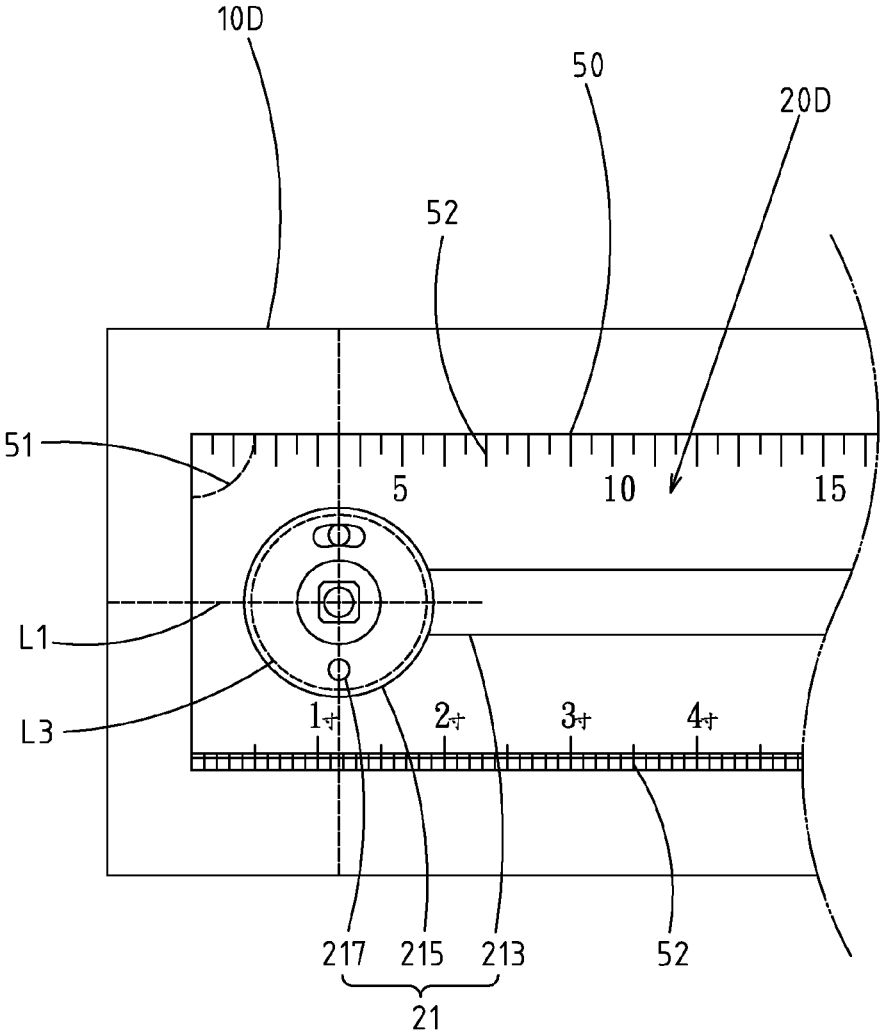
FIG. 11 shows a partial close-up back view of the second embodiment of the invention.

As shown in FIG. 10 and FIG. 11, a second embodiment of an instructional template for aiding the installation of wall brackets as provided by the invention, is shown. The template is comprised of:

a packing box 10D, which provides a compartment for accommodating the prefabricated wall brackets 05; and a template 20D, which pertains to a one-body construction placed at one side of the packing box 10D, where contained above the template 20D are hole marking drawing 21 at a 1:1 scale depicting the assembly layout of the wall bracket 05 kit assembly holes. The round feature of the hole layout drawing 21, portions of the perforation, and purpose of the template and intended usage are identical to that described under the foregoing first embodiment, and will not be repeated.

In accordance with the foregoing described configuration mode, the template 20D has been incorporated with a rectangle perforation 50 to semi-connect to one side of the pacing box 10D allowing it to be operated alone when torn from the template 20D.

Figure 12:
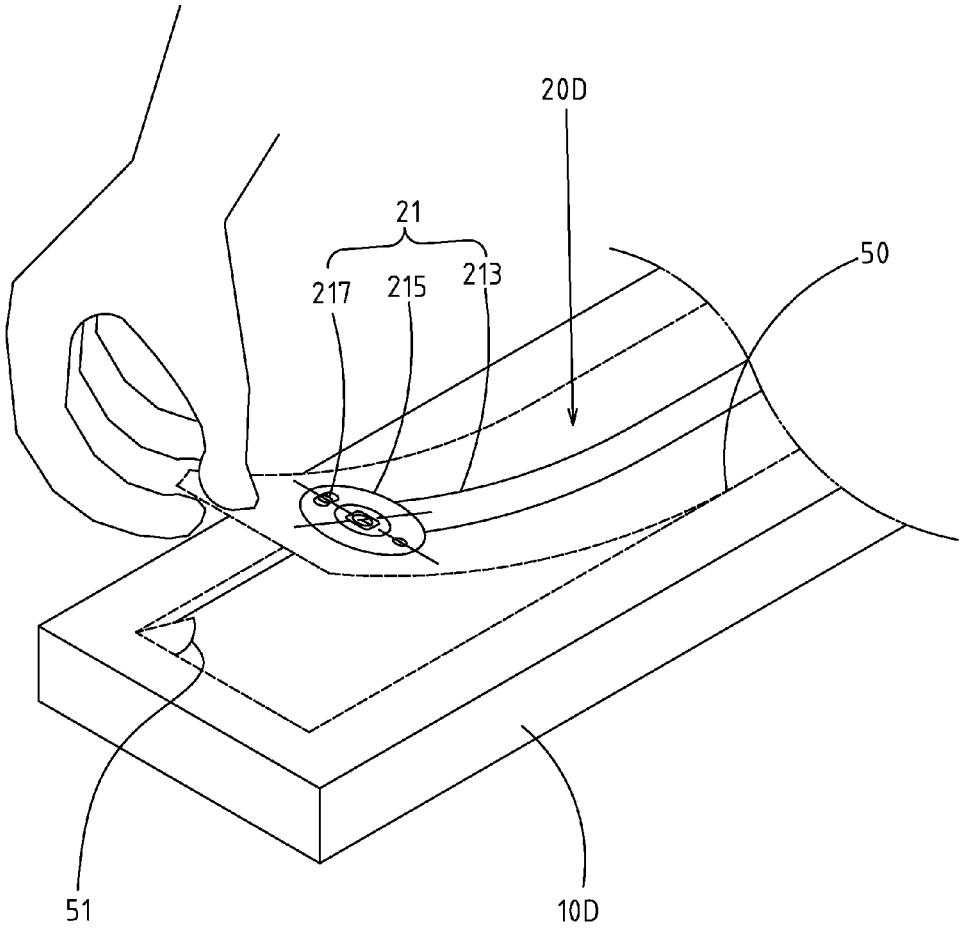
FIG. 12 shows a perspective view of a torn template as depicted under the second embodiment of the invention.
Figure 13:
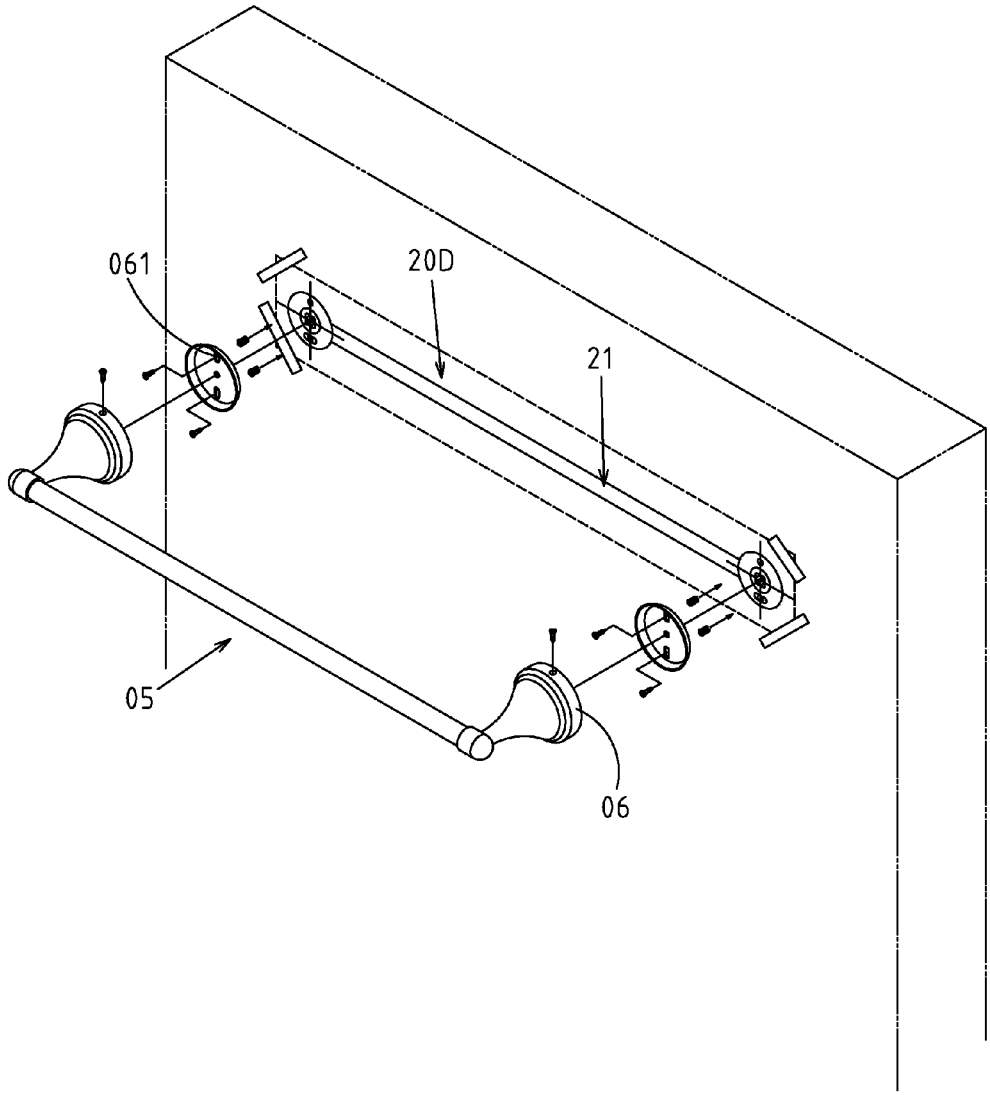
FIG. 13 shows a perspective view of the template mounted on the wall as shown for the second embodiment of the invention.

One or more corners adjacent to the rectangle perforation 50 of a curve die-cut 51 can be incorporated. The corners, can be pressed down for finger access that allows puncturing the hole and tearing open the template 20D with the finger, as shown in FIG. 12. In such way, and as shown in FIG. 13, the hole boring will be able to proceed by affixing the template 20D onto the wall as per methods as disclosed under the first embodiment.

Whereof, as shown in FIG. 3 and FIG. 11, the parameters of the template 20, 20D disclosed in the foregoing illustration implementations could further be incorporated with the design of dimensional imprint 52, i.e. in metric centimeter or imperial inch, which would facilitate the consumer to dimensional measuring during the installation process.

Figure 14:
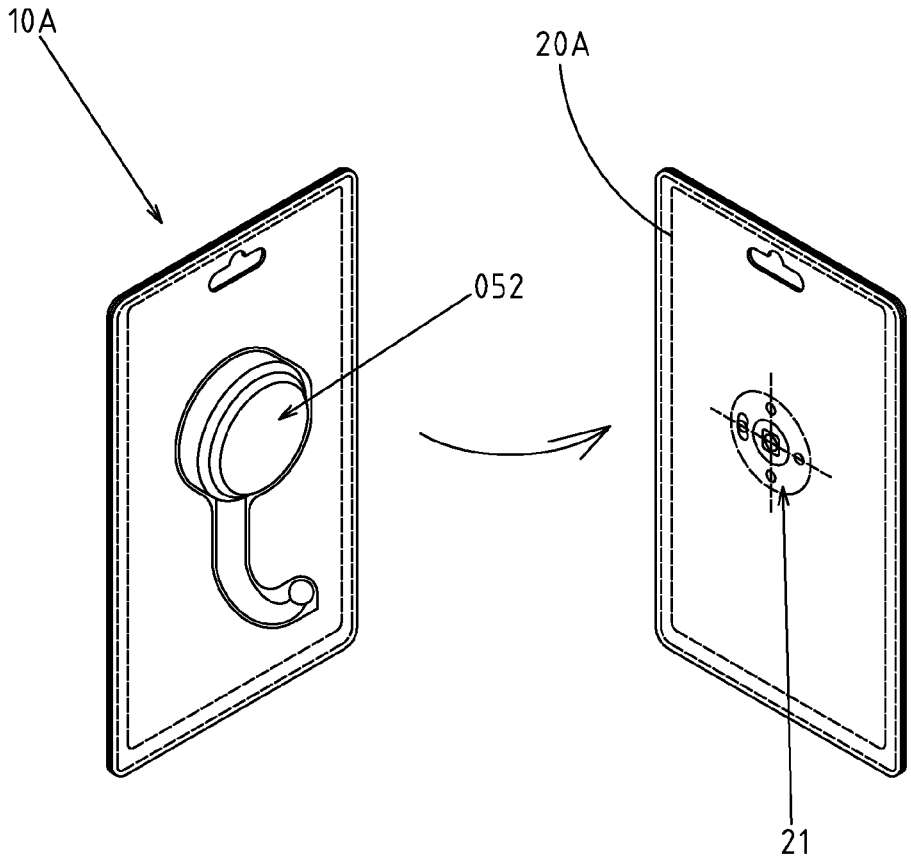
FIG. 14 shows a perspective front and back view of an alternative means of wall bracket configuration as proposed by the invention.
Figure 15:
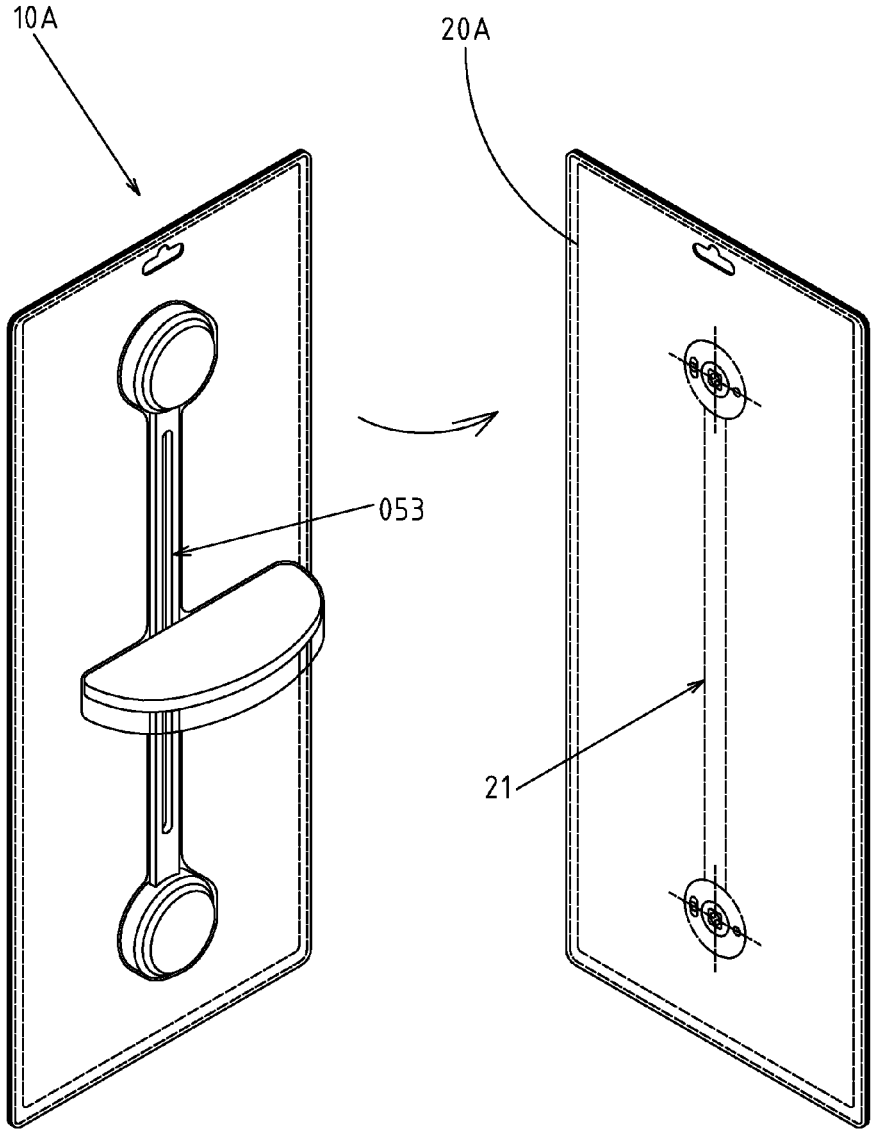
FIG. 15 shows another perspective front and back view of still another alternative means of wall bracket configuration as proposed by the invention.
Figure 16:
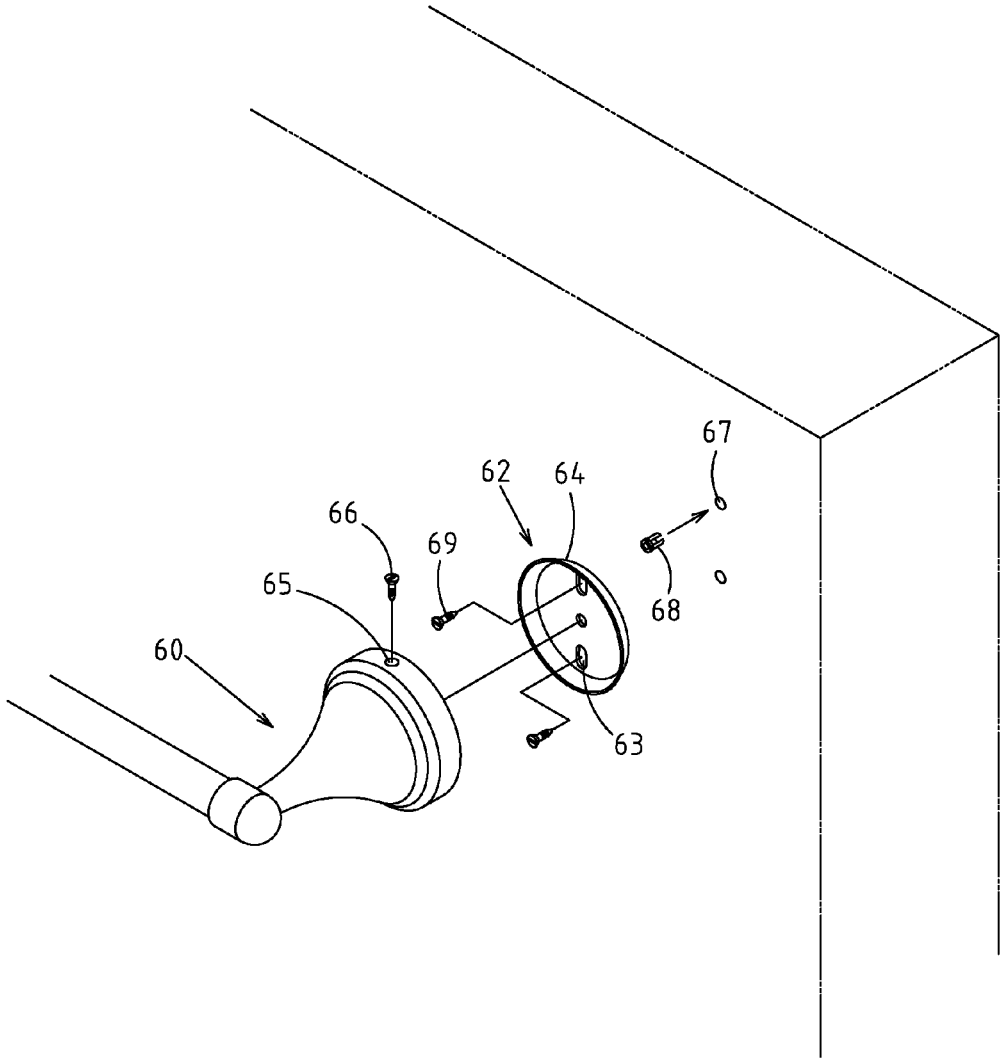
FIG.16 PRIOR ART
FIG. 16 shows a perspective view of components of the mounting point of the conventional wall bracket kit in the prior art.
Figure 17:
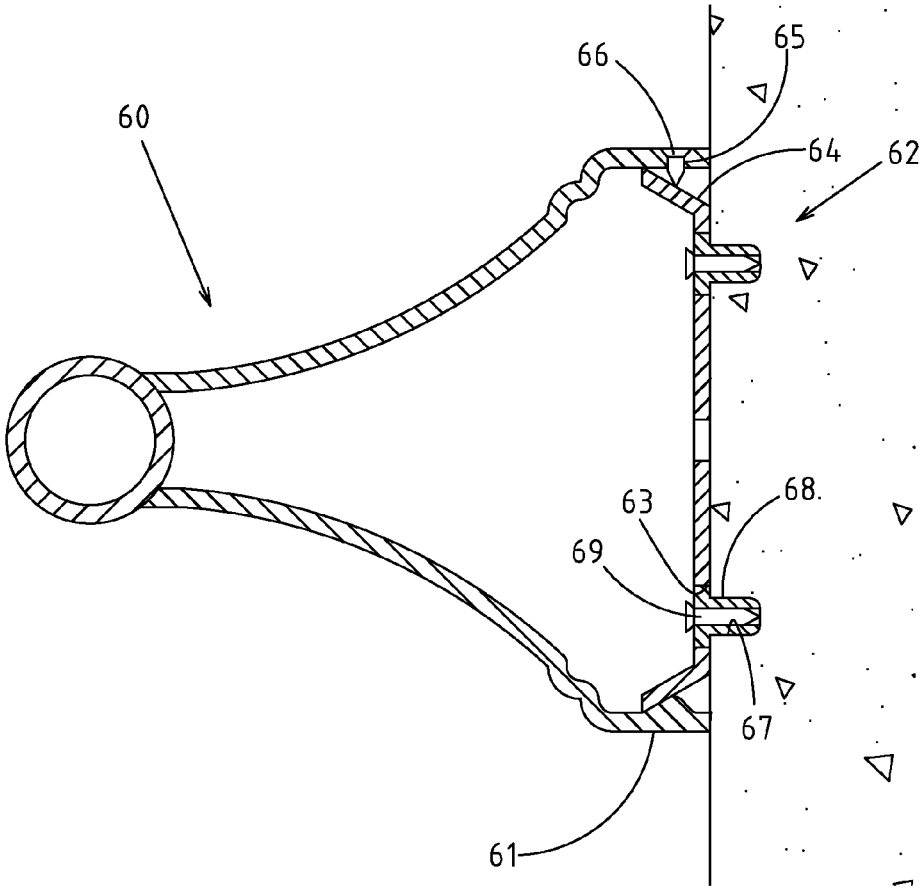
FIG.17 PRIOR ART
FIG. 17 shows a cross-sectional view of the mounting point being mounted on to the wall of the conventional wall bracket kit in the prior art.

As a supplement, there is no preset limit as to the configuration of the wall bracket as referred in the invention, and as long as those that the contact points require mounting onto the walls would all fall under the scope of this patent. For instance, those shown under FIG. 14 and FIG. 15 are variation wall brackets of different configurations, where FIG. 14 depicts a single mount wall bracket 052, whereas FIG. 15 depicts an upright wall bracket 053 in an infinite array of combinations to be free from preset confines.

I claim:

1. An assembly comprising:

a packing box having an interior compartment, said packing box having an upper casing and a lower casing;

a wall bracket received in said packing box, said upper casing defining a holding compartment for said wall bracket, said lower casing having a generally planar shape, said bracket having assembly holes formed therein; and a template of a planar shape received in said packing box against said planar shape of said lower casing, said template having hole markings thereon corresponding identically in location to said location of said assembly holes of said wall bracket, said template interposed between a surface of said wall bracket and said planar surface of said lower casing.

2. The assembly of claim 1, said upper casing being interlocked to said bottom casing, said packing box having a hang hole at one end thereof.

3. The assembly of claim 1, said lower casing being hingedly connected along one edge to upper casing.

4. The assembly of claim 1, said template being attached to said packing box.

5. The assembly of claim 1, said template having a contour outline thereon, said contour outline conforming outline thereon, said contour outline conforming to a profile of said wall bracket.

6. The assembly of claim 1, said template having perforations around said hole markings.

7. The assembly of claim 1, said template having dimensional indicia imprinted along at least one side thereof.

* * * * *